US009790657B2

(12) United States Patent
Pastor et al.

(10) Patent No.: US 9,790,657 B2
(45) Date of Patent: Oct. 17, 2017

(54) METHOD FOR WATERPROOFING UNDERGROUND STRUCTURES

(71) Applicant: THUR S.R.L., Verona (IT)

(72) Inventors: Mariapia Pastor, Bosco Chiesanuova (IT); Andrea Birtele, Verona (IT)

(73) Assignee: THUR S.R.L., Verona (IT)

( * ) Notice: Subject to any disclaimer, the term of this patent is extended or adjusted under 35 U.S.C. 154(b) by 27 days.

(21) Appl. No.: 14/778,490

(22) PCT Filed: Mar. 17, 2014

(86) PCT No.: PCT/EP2014/055265
§ 371 (c)(1),
(2) Date: Sep. 18, 2015

(87) PCT Pub. No.: WO2014/147012
PCT Pub. Date: Sep. 25, 2014

(65) Prior Publication Data

US 2016/0168819 A1 Jun. 16, 2016

(30) Foreign Application Priority Data

Mar. 18, 2013 (IT) ..... VR2013A0069

(51) Int. Cl.
*E02D 31/02* (2006.01)
*E02D 31/10* (2006.01)

(52) U.S. Cl.
CPC ..... *E02D 31/02* (2013.01); *E02D 31/10* (2013.01)

(58) Field of Classification Search
CPC ..... E02D 31/02
USPC ..... 264/DIG. 80; 405/150.2; 427/140, 427/427.4; 52/515, 516, 517, 741.41, 52/169.14
See application file for complete search history.

(56) References Cited

U.S. PATENT DOCUMENTS 1,796,269 A * 3/1931 Rose ..... E04B 1/62 106/277
4,211,050 A * 7/1980 Cvacho ..... E02D 31/02 239/271
4,520,051 A * 5/1985 Harrison ..... E04B 1/648 264/DIG. 80

FOREIGN PATENT DOCUMENTS

DE 19504489 * 8/1996
JP 7-275772 * 10/1995
WO 2011104431 A1 9/2011
WO 2012085342 A1 6/2012

OTHER PUBLICATIONS

International Search Report and Written Opinion dated Jun. 27, 2014 re: Application No. PCT/EP2014/055265; pp. 1-8.

* cited by examiner

*Primary Examiner* — Sunil Singh
(74) *Attorney, Agent, or Firm* — Cantor Colburn LLP

(57) ABSTRACT

A method for water-proofing underground structures (10) comprising: a step of injecting an expanding compound adjacent to the surface (10*b*) directed toward the outside of an underground structure (10) to be waterproofed in order to form at least two confinement portions (2); a step of injecting a diffusing compound (4) intended to harden adjacent to the surface (10*a*) directed toward the outside of the underground structure (10) and at a completion region (3) that is delimited by said at least two confinement portions (2).

16 Claims, 9 Drawing Sheets

METHOD FOR WATERPROOFING UNDERGROUND STRUCTURES

TECHNICAL FIELD

The present invention relates to a method for waterproofing underground structures such as basement walls or flooring.

This method, in particular, can be used on existing structures that are in contact with the ground and for which it is not possible and/or convenient to intervene with ordinary insulation/waterproofing methods.

BACKGROUND

During the building of a new structure it is common practice to provide systems for insulating the foundations and the portions of masonry that are in contact with the ground, in order to avoid infiltrations and/or the capillary rise of water. Elastomeric sheets, in roll form or liquid form, laid between the structure and the ground, are normally used.

If these systems have not been provided or if their functionality over time is compromised, infiltrations of water may occur or damp stains may appear due to the impregnation by capillary action of the building materials.

The retrofitting of a waterproofing system or the restoration of the functionality of an existing system is a rare practice due to the operating difficulties that arise from it.

Indeed, if one wished to intervene from the outside, one would have to perform excavations along the entire perimeter of the wall in order to be able to position or restore the installation. Nevertheless, it would not be possible to ensure the waterproofing of the flooring.

Placing the insulation on the internal surfaces would block infiltrations but not capillary rise in the wall. This type of waterproofing would entail in any case, in most cases, the removal of surface coverings (tiles, plasters, . . . ).

Similar problems occur also in other civil structures, such as for example tunnels, containment walls, underground tanks.

Methods for waterproofing after building by means of injections have already been used for years. They can be performed both within the wall face to be waterproofed, in order to saturate the voids that are present, and behind said wall face, in order to create a waterproofing barrier between the wall and the ground.

The products used can be of different types, for example polyurethane resins, acrylic resins or silicate mixtures.

The injections performed behind the wall are performed in the following steps of operation:

perforation of the masonry:

placement of plugs in the holes (to avoid the outflow of the injected material);

execution of the injections, starting from the areas located at lower heights and proceeding by successive horizontal alignments toward the top of the wall face.

The injected products, initially in the liquid state, harden in more or less short times and become waterproof. The times required for the injected mixture to pass from the liquid state to the solid state are a function of the type of reagents used. They can vary from a few seconds, as in the case of polyurethane resins, to a few hours for silicate mixtures.

With reference to injections of polyurethane resins, it is noted that they have excellent mechanical properties, short reaction times, high initial viscosities of the mixture and the possibility of expanding their initial volume during the hardening reaction.

This makes it possible to achieve good results if there is a cracked containment wall in which it is necessary to block substantial water seepage.

However, the main drawbacks of processes that use polyurethane resins are the cost of the raw material and the need to use rather expensive equipment.

Moreover, since these resins expand very quickly, one cannot be sure that they are able to permeate the smaller voids.

On the other hand, the injection of silicate mixtures is characterized by extremely well adjustable reaction times, by low initial viscosity of the mixture, by much lower costs of the raw material with respect to polyurethane resins, and by the fact that they require simplified and less expensive injection systems.

However, it is observed that waterproofing by means of silicate mixtures is ineffective if even just one portion of the containment wall to be waterproofed is cracked or subject to substantial seepage of water, since this would cause the mixture to be washed out in a very short time, which would lead to the consequent restoration of the initial situation of infiltrations if they are injected into the entire wall.

Furthermore, the extremely low viscosity of silicate mixtures at the time of their injection into the ground makes it very difficult to check their adhesion to the entire surface of the underground wall that must be subjected to waterproofing.

BRIEF SUMMARY

The aim of the present invention is to solve the problems and obviate the drawbacks described above, providing a method for waterproofing underground structures, such as basement walls or flooring, that allows effective waterproofing of an underground structure even if it is subject to substantial seepage of water in a short time.

Within this aim, a method is provided for waterproofing underground structures, such as basement walls or flooring, that makes it possible to intervene to integrate the intervention in a targeted manner even at a later time.

Further, a method is proposed for waterproofing underground structures such as basement walls or flooring that has a low invasiveness and is capable, in many cases, of allowing the execution of the method by acting from the outside without perforating the wall.

This aim is achieved by a method for waterproofing underground structures, such as basement walls or flooring, as described herein.

BRIEF DESCRIPTION OF THE DRAWINGS

Further characteristics and advantages of the invention will become more apparent from the description of some preferred but not exclusive embodiments of the method for waterproofing underground structures such as basement walls or flooring according to the invention, illustrated by way of non-limiting example in the accompanying drawings, wherein.

DETAILED DESCRIPTION

Figure 2:
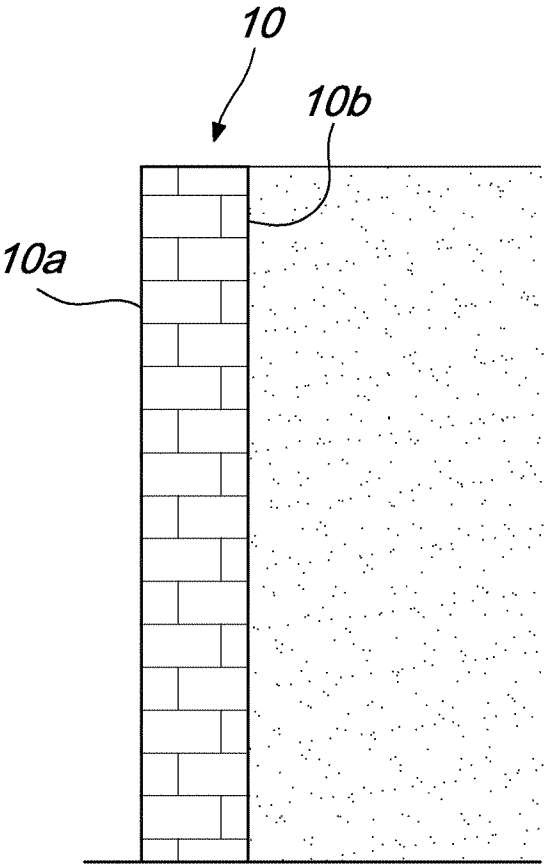
FIG. 2 is a sectional view of the wall structure, along the plane of arrangement defined by the plane II-II of FIG. 1.
Figure 1:
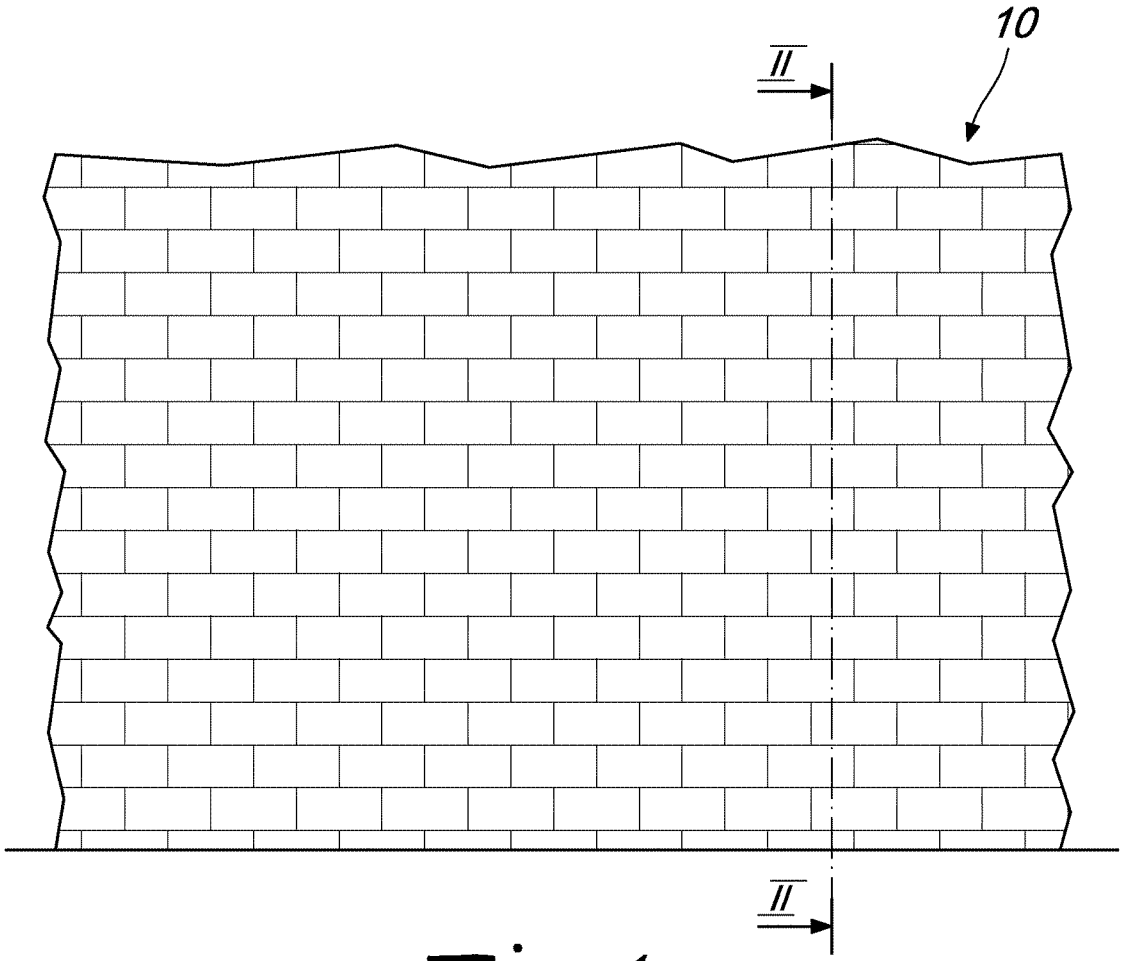
FIG. 1 is a view, taken from the outside, of an underground structure to be waterproofed.
Figure 4:
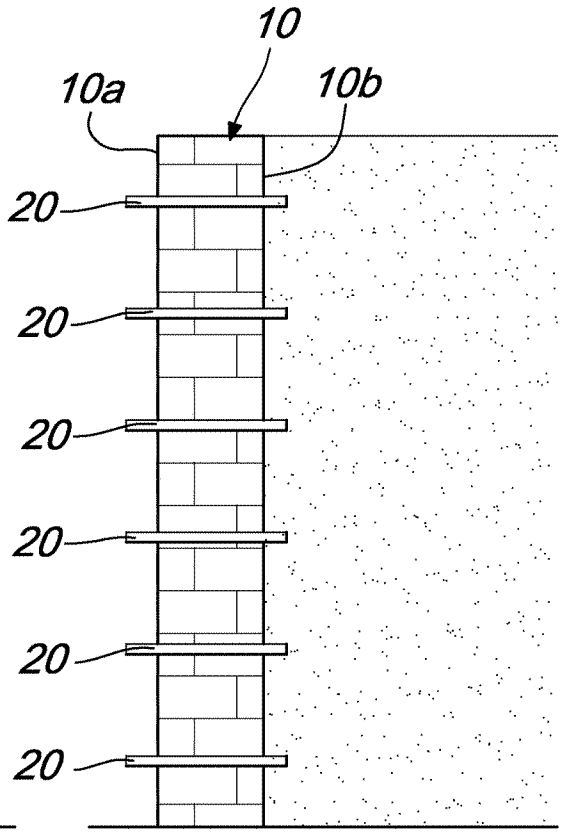
FIG. 4 is a sectional view of the underground structure, along the plane of arrangement defined by the plane IV-IV of FIG. 3.
Figure 3:
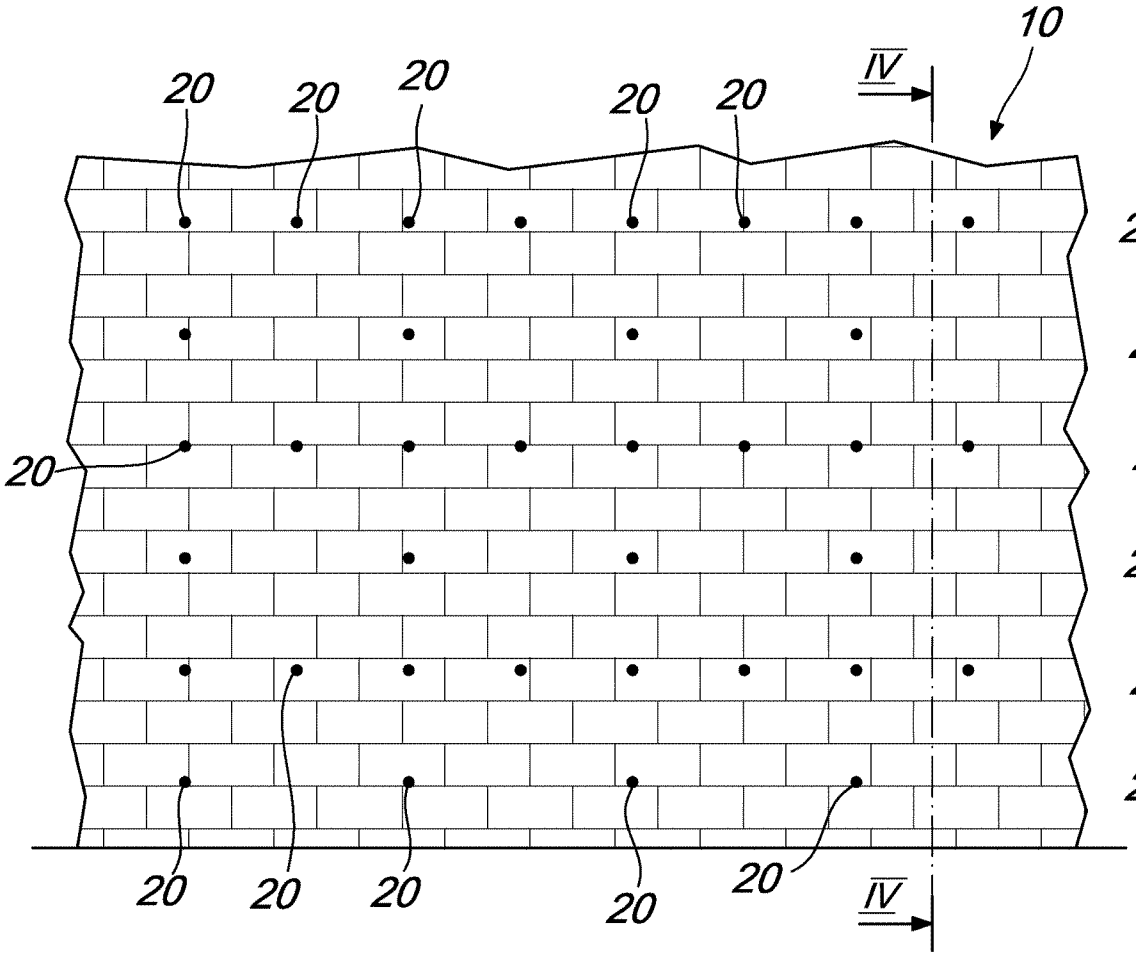
FIG. 3 is a view, similar to FIG. 1, in which the first injection tubes have been inserted through the underground structure.
Figure 5:
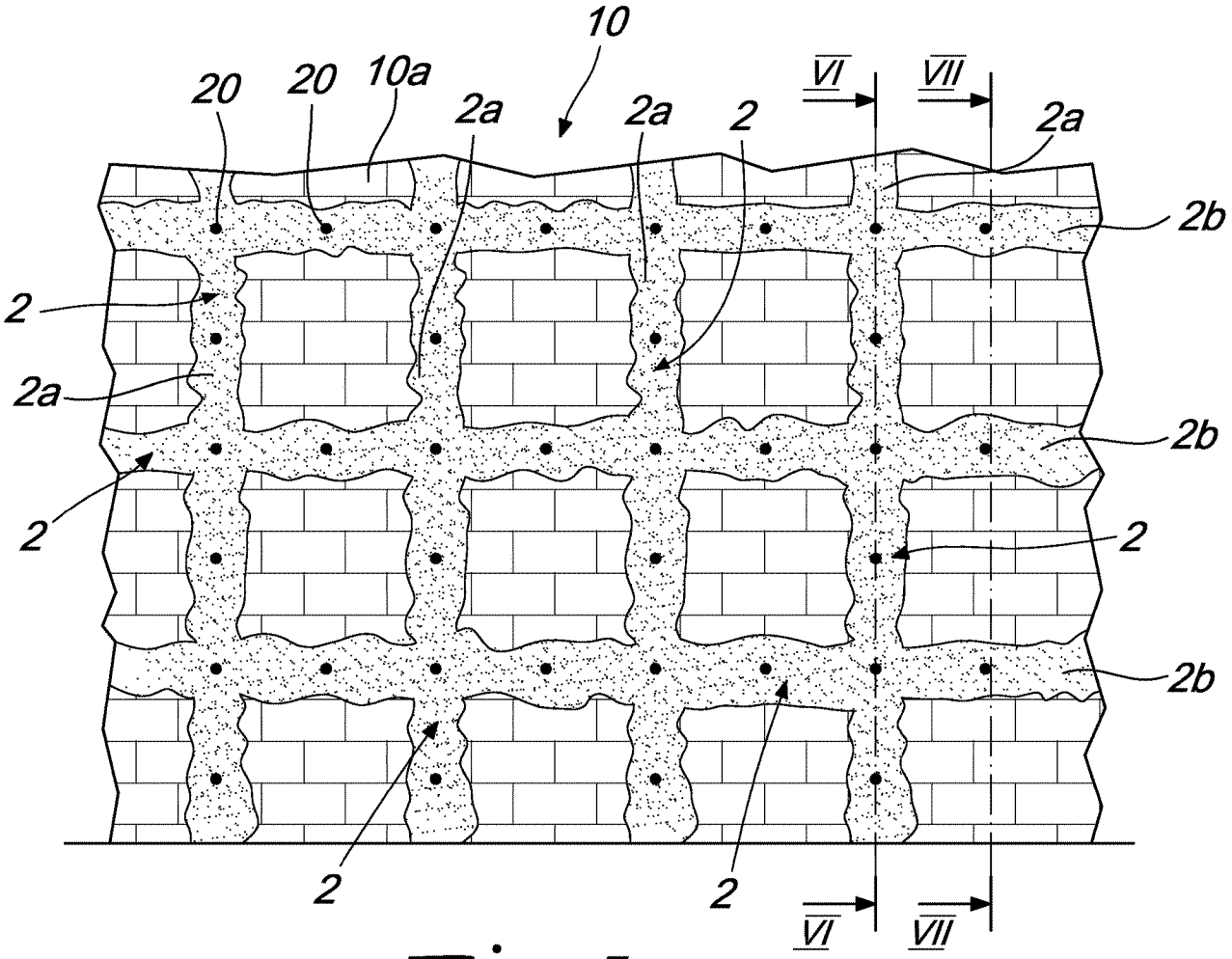
FIG. 5 is a view, similar to FIG. 3, in which the polyurethane resin has been injected through the first injection tubes.
Figure 7:
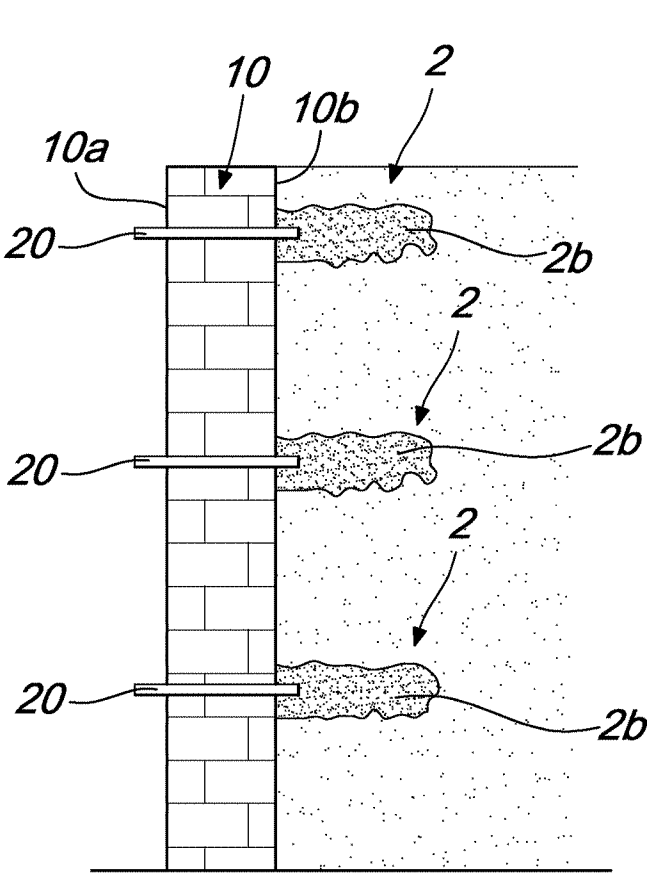
FIGS. 6 and 7 are respective sectional views of the underground structure, along the plane of arrangement defined by the planes VI-VI and VII-VII of FIG. 5.
Figure 6:
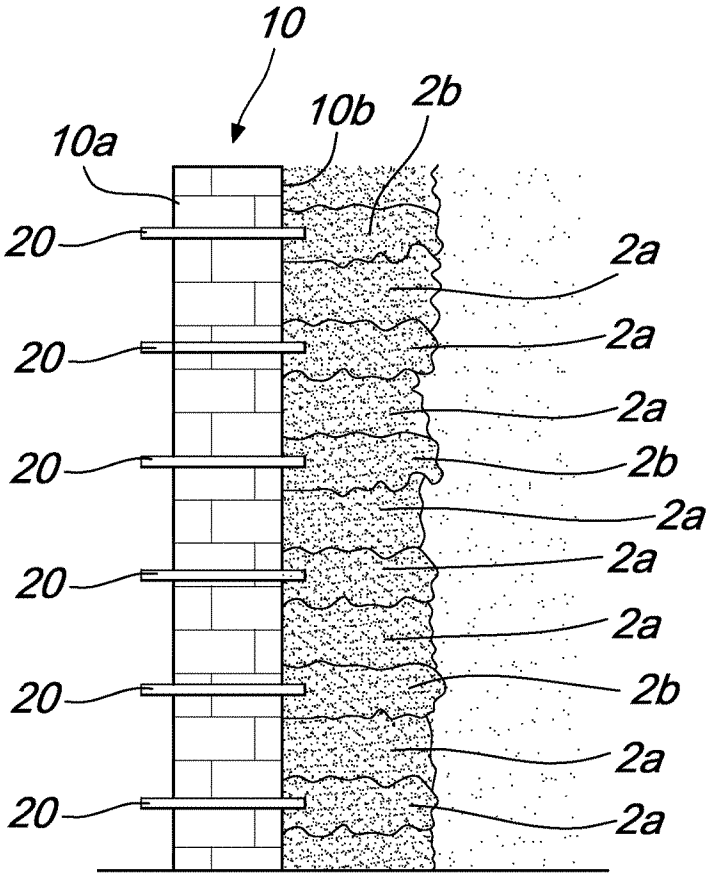
Figure 9:
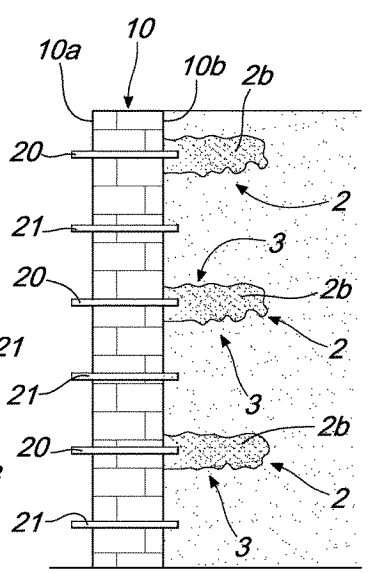
FIG. 9 is a sectional view of the underground structure, along the plane of arrangement defined by the plane IX-IX of FIG. 8.
Figure 8:
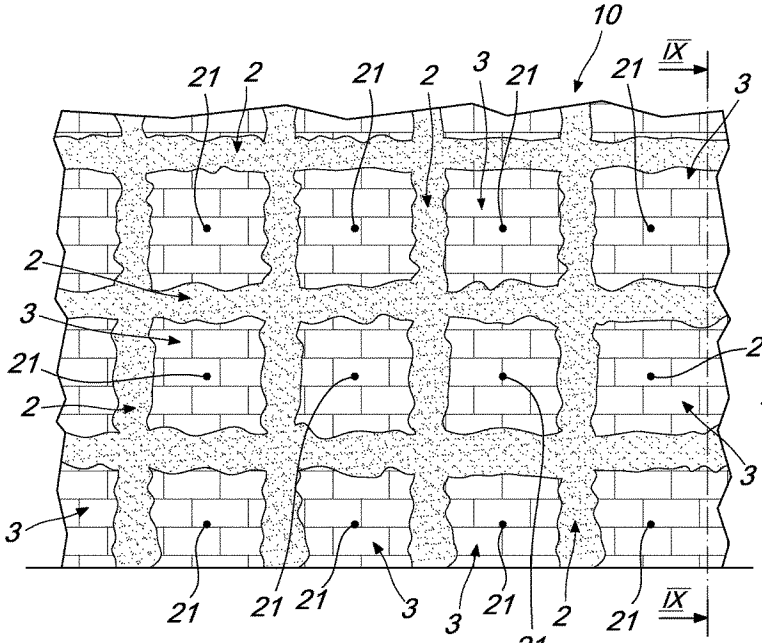
FIG. 8 is a view, similar to FIG. 5, in which the second injection tubes have been inserted through the underground structure.
Figures 10, 11:
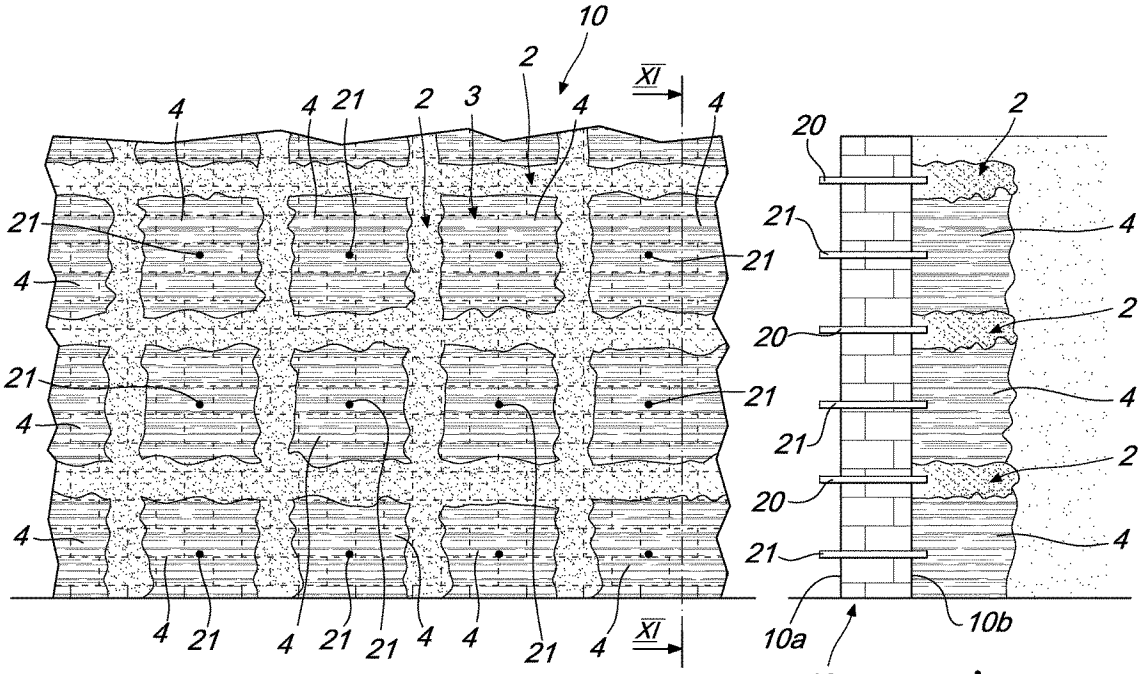
FIG. 10 is a view, similar to FIG. 8, in which the silicate mixture has been injected through the second injection tubes.
FIG. 11 is a sectional view of the underground structure, along the plane of arrangement defined by the plane XI-XI of FIG. 10.
Figure 13:
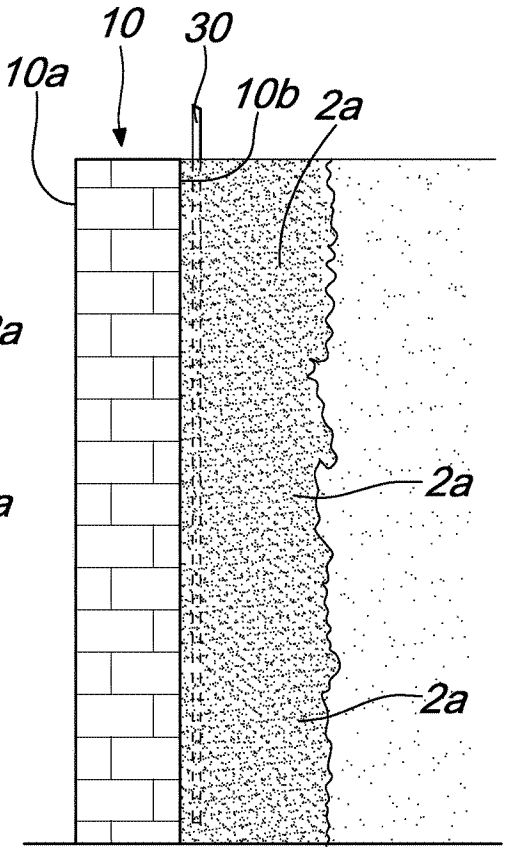
FIG. 13 is a sectional view of the underground structure, along the plane of arrangement defined by the plane XIII-XIII of FIG. 12.
Figure 12:
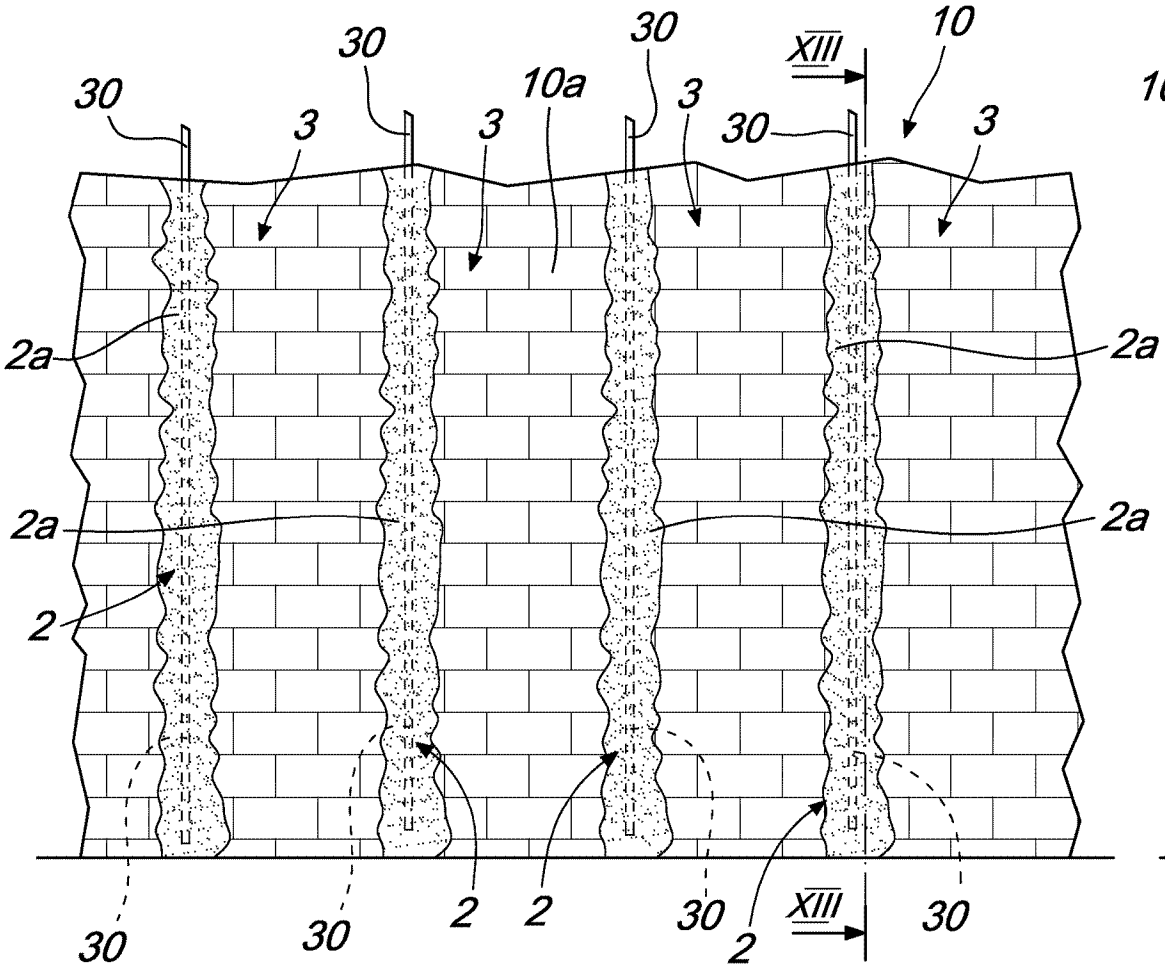
FIG. 12 is a view of a second constructive variation of the method according to the invention, in which the polyurethane resin has been injected from the outside and through first injection tubes.
Figure 15:
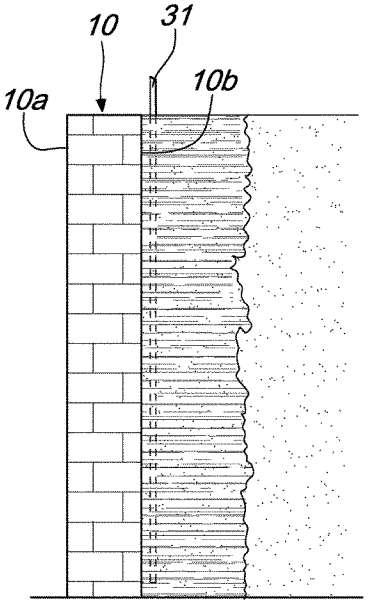
FIG. 15 is a sectional view of the underground structure, along the plane of arrangement defined by the planes XV-XV of FIG. 14.
Figure 14:
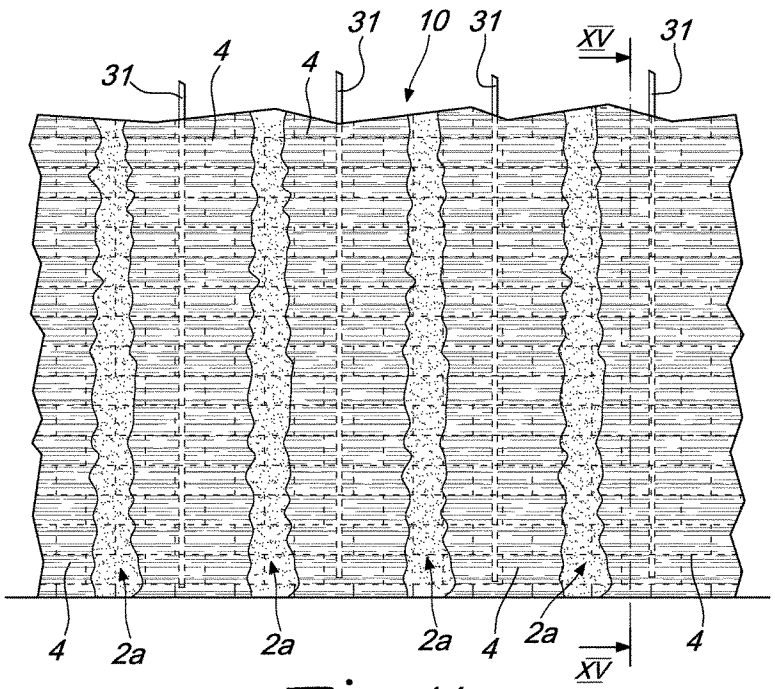
FIG. 14 is a view, similar to FIG. 12, in which the second injection tubes have been inserted from the outside and in which the silicate mixture has been injected through the second injection tubes.

In the exemplary embodiments that follow, individual characteristics, given in relation to specific examples, may actually be interchanged with other different characteristics that exist in other exemplary embodiments.

With reference to the cited figures, the present invention relates to a method for waterproofing underground structures 10, such as for example basement walls or flooring.

In particular, the method comprises:

- a step of injecting an expanding compound adjacent to the surface 10*b* directed toward the outside of an underground structure 10 to be waterproofed in order to form at least two confinement portions 2;
- a step of injecting a diffusing or permeating compound intended to harden adjacent to the surface 10*b* directed toward the outside of said underground structure 10 and at a completion region 3 that is delimited by said at least two confinement portions 2.

Conveniently, the methods provides, in sequence, the step of injecting the expanding compound and the step of injecting the diffusing or permeating compound.

Advantageously, the silicate mixture is adapted to diffuse and harden so as to cover substantially uniformly the entire completion region 3 delimited by the at least two confinement portions 2.

The expanding compound to be injected is selected from the group comprising:

a polyurethane resin;
a urea resin;
a silicone foam;
or mixtures thereof.

Advantageously, the expanding compound comprises a polyurethane resin.

The diffusing compound is selected from the group comprising:

a silicate mixture;
a polyester resin;
an epoxy resin;
or mixtures thereof.

Conveniently, the diffusing compound comprises a silicate mixture.

Advantageously, the expanding compound that is used may have an expansion starting time of less than five minutes.

Such expanding compound, at the end of free air polymerization, typically has a density comprised between 30 $kg/m^3$ and 500 $kg/m^3$.

Conveniently, its increase in volume, once hardened, is comprised between 2 and 35.

The diffusing compound hardens, once injected, in no more than five hours and preferably in a time comprised between 30 minutes and 3 hours.

Advantageously, the diffusing compound has a density, at the time of injection, substantially equal to 1 and an increase in volume, once hardened, comprised between 1 and 1.2.

According to a preferred embodiment, the two confinement portions 2 comprise respective first longitudinal bands 2*a* that extend in a first extension direction and are mutually spaced.

In the case of vertical wall structures 10, the first extension direction can be the vertical or the horizontal direction.

The two confinement portions 2 can comprise two contiguous portions with longitudinal extension that extend in the same direction of extension so as to define a continuous longitudinal band. Said continuous longitudinal band can have an extension in a horizontal or an inclined direction.

As shown in FIGS. 1 to 11, the confinement portions 2 comprise, in addition to the first longitudinal bands 2*a*, also respective second longitudinal bands 2*b* that extend in a second extension direction that is inclined with respect to said first extension direction.

Conveniently, said second extension direction is arranged substantially perpendicular to the first extension direction.

Thus, the confinement portions 2 have a matrix-like extension and the completion regions 3 are constituted by square portions that are delimited on their four sides by the edges of the confinement portions 2.

Figures 16, 17:
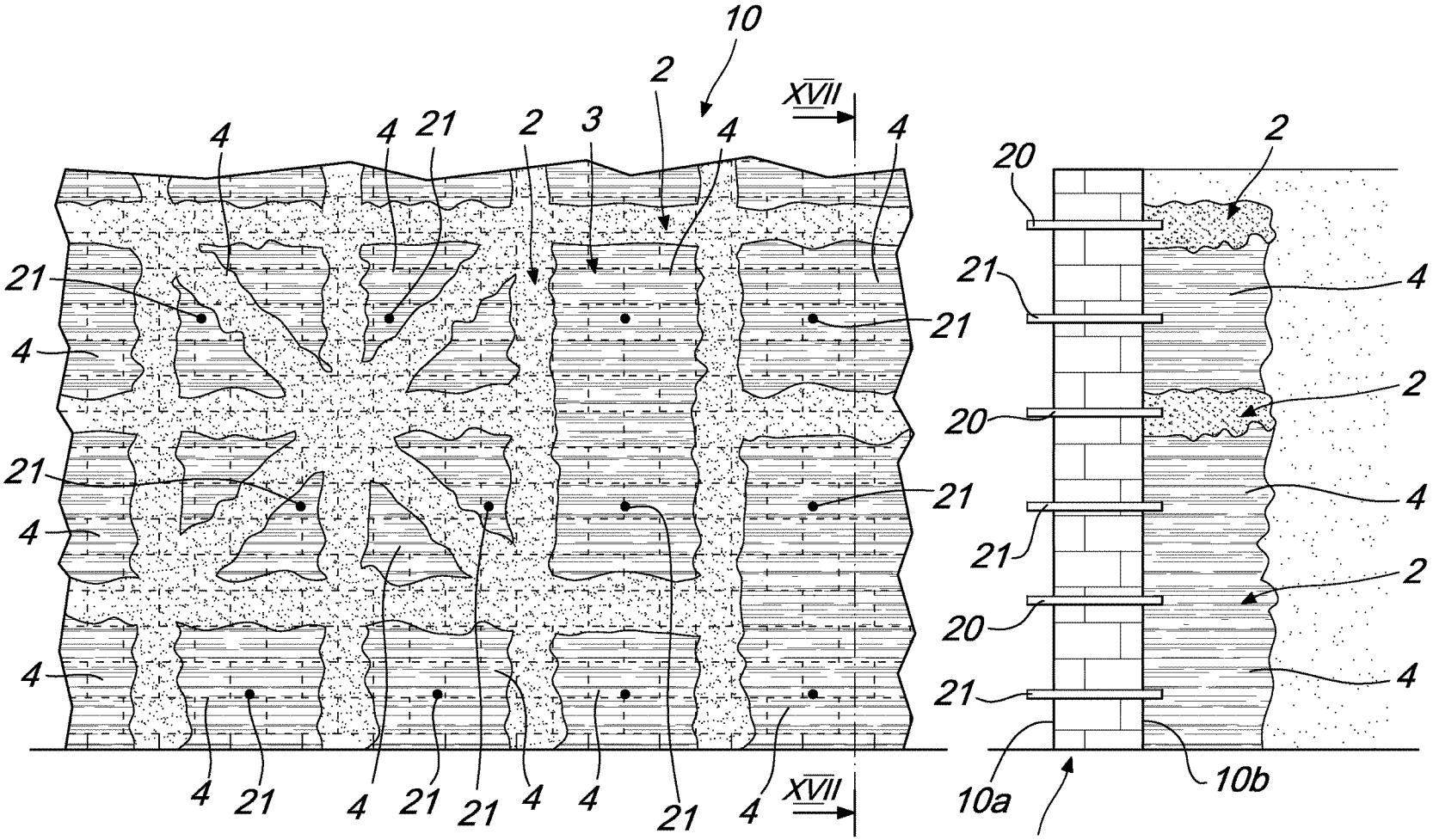
FIG. 16 is a view similar to FIG. 10.
FIG. 17 is a sectional view of the underground structure, along the plane of arrangement defined by the plane XVII-XVII of FIG. 16.

Of course, nothing prevents the completion portions 3 from also having mutually different shapes and dimensions (triangular, hexagonal, rectangular, etc.), as shown schematically for example in FIG. 16.

More precisely, the method comprises a step of inserting first tubes 20, 30 for the injection of the expanding compound and a step of insertion of second tubes 21, 31 for injecting the diffusing compound.

With reference to the method shown in FIGS. 1 to 11, the first injection tubes 20 and the second injection tubes 21 are inserted from the inside of the building, perforating the underground structure 10 from the surface facing the inside 10*a*, to terminate with their dispensing tip adjacent to the surface 10*b* facing the outside of the underground structure 10 to be waterproofed.

In this case, the first injection tubes 20 and the second injection tubes 21 extend in an extension direction that is substantially perpendicular to the plane of arrangement of the underground structure 10 to be waterproofed.

Alternatively, as shown in FIGS. 12 to 15, the first injection tubes 30 and the second injection tubes 31 can be inserted from the outside of the building to terminate adjacent to the surface 10*b* facing the outside of the underground structure 10 to be waterproofed.

In this case, the first and second injection tubes 30, 31 extend in an extension direction that is substantially parallel to the plane of arrangement of the underground structure 10 to be waterproofed.

Once the injection of the expanding compound, typically a polyurethane resin, and of the diffusing compound 4 (for example a silicate mixture) has been completed, the method provides for the removal of the first and second injection tubes 20, 21, 30, 31.

The first tubes 20, 30 can also be left in place, also because their use is often rendered impossible by the fact that the expanding compound hardens inside them as well.

Advantageously, the method provides the confinement portions 2 at regions of the underground structure 10 that are subject to seepage of water and to cracking.

In practice, the method according to the invention has the advantage of combining the positive aspects of the technologies of injecting expanding compounds such as polyurethane resins and diffusing compounds such as silicate mixtures.

Also in relation to the low viscosity of the diffusing compound, at least some of the second tubes 21 can be positioned substantially at the top of the completion regions 3 so that the diffusing compound, by percolating downward, permeates at the entire completion region 3.

The proposed method makes it possible to obtain a continuous barrier with extremely low permeability (permeability coefficient K in the order of $10^{-7}$ m/s). The volume of ground treated behind the wall has a variable thickness that depends on the initial permeability of the ground and on the quantity of product that is injected but also on the depth of insertion of the injection tubes 20, 21, 30, 31.

The "thickness" of the barrier that is provided is constituted by the sum of the thickness of any voids that are present (saturated with the diffusing and expanding compounds) and the thickness of ground permeated by the injections. This thickness, therefore, can be changed also on the basis of the particular required design specifications.

In practice, the method provides for the execution of "sectorial" injections behind the wall after perforation and after insertion of the injection tubes 20, 21, 30, 31 in order to make it possible to convey the expanding and diffusing compounds into the volumes of ground that lie behind.

The main goal is to divide the area to be treated into parcels of smaller size. The limits of the parcels are provided by injecting an expanding compound and specifically polyurethane resins. The volumes of ground contained within each parcel are then saturated with diffusing compounds such as silicate mixtures.

As mentioned earlier, the injections of expanding compounds (polyurethane resins) also have the task of filling the macroscopic voids and therefore of blocking the main seepage of water.

Complete waterproofing of the wall face is achieved with the subsequent injection of diffusing compounds (silicate mixtures).

The division of the area to be treated into smaller parcels, furthermore, allows monitoring of the treated wall, making it possible to circumscribe more easily the more problematic regions on which the injections of compounds are to be extended and/or integrated until the structure is completely waterproofed.

The presence of longitudinal bands 2*b* that extend in a horizontal direction makes it possible to prevent the subsequent injection of diffusing compounds (which have a viscosity comparable to the viscosity of water) from percolating downward excessively, allowing the use of diffusing compounds such as silicate mixtures that have longer hardening times, so as to ensure the filling also of the smaller cavities.

When possible, the injections are performed without perforating the wall, by working (as shown in FIGS. 12 to 15) from the external plane of site and by placing the injection tubes in parallel to the external wall.

The waterproofing method according to the present patent application has the goal of introducing the following improvements over existing similar technologies:

- the possibility of blocking substantial seepage of water in a short time;
- the delimiting of circumscribed areas (with expanding compounds such as polyurethane resins) to avoid dispersion of the diffusing compounds (silicate mixtures) injected subsequently;
- the division of the entire area into smaller parcels: swiftness in identifying the most problematic parcels on which the treatment is to be prolonged/integrated until complete waterproofing is achieved;
- the possibility of integrating intervention even at a later time;
- the possibility of acting on the thickness of the barrier, varying the insertion depth of the injection tubes;
- low invasiveness linked to the small diameter of the perforations;
- if certain conditions are met, the possibility of performing the injections from the outside without perforating the wall;
- installation without having to perform excavations or demolitions;
- reduction of costs if there are important volumes of voids to be filled;
- use of "light" products that do not affect negatively the structure and the ground.

In addition to these advantages, the injections can be performed also in the wall face in order to saturate the voids that are present and therefore block further the possible water passages.

In practice, the dimensions may be any according to the requirements.

All the details may furthermore be replaced with other technically equivalent elements.

The invention claimed is:

1. A method for waterproofing an underground structures comprising:

a step of injecting an expanding compound adjacent to a surface directed toward an outside of the underground structure to be waterproofed in order to form at least two confinement portions;

a step of injecting a diffusing compound intended to harden adjacent to the surface directed toward the outside of said underground structure and at a completion region that is delimited by said at least two confinement portions.

2. The method according to claim 1, further comprises performing said step of injecting a diffusing compound after said step of injecting an expanding compound.

3. The method according to claim 1, wherein said expanding compound is selected from the group consisting of:

a polyurethane resin;

a urea resin;

a silicone foam;

or mixtures thereof.

4. The method according to claim 1, wherein said expanding compound comprises a polyurethane resin.

5. The method according to claim 1, wherein said diffusing compound is selected from the group consisting of:

a silicate mixture;

a polyester resin;

an epoxy resin;

or mixtures thereof.

6. The method according to claim 1, wherein said diffusing compound comprises a silicate mixture.

7. The method according to claim 1, wherein said diffusing compound is adapted to diffuse so as to cover substantially uniformly the entire completion region delimited by said at least two confinement portions.

8. The method according to claim 1, wherein said at least two confinement portions comprise respective longitudinal bands that extend in a first extension direction and are mutually spaced.

9. The method according to claim 8, wherein said confinement portions comprise respective longitudinal bands that extend in a second extension direction that is inclined with respect to said first extension direction.

10. The method according to claim 9, wherein said second extension direction is substantially perpendicular to said first extension direction.

11. The method according to claim 1, further comprising a step of inserting first tubes for the injection of said expanding compound and a step of the insertion of second tubes for injecting said diffusing compound.

12. The method according to claim 11, wherein said first and/or second injection tubes are inserted from the inside of the building to terminate adjacent to the surface facing the outside of said underground structure to be waterproofed and extend in an extension direction that is substantially perpendicular to the plane of arrangement of said underground structure.

13. The method according to claim 11, wherein said first and/or second injection tubes are inserted from the outside of a building to terminate adjacent to the surface facing the outside of said underground structure to be waterproofed and extend in an extension direction that is substantially parallel to a plane of arrangement of said underground structure.

14. The method according to claim 1, further providing said confinement portions at regions of said underground structure that are subject to seepage of water and to cracking.

15. The method according to claim 1, wherein said expanding compound has an expansion start time of less than 5 minutes and has, at an end of free air polymerization, a density comprised between 30 $kg/m^3$ and 500 $kg/m^3$ and an increase in volume, once hardened, comprised between 2 and 35.

16. The method according to claim 1, wherein said diffusing compound hardens, once injected, in less than 5 hours and has a density, at a time of injection, that is substantially equal to 1 and an increase in volume, once it has hardened, comprised between 1 and 1.2.

* * * * *